US005801318A

United States Patent [19]

Tani et al.

[11] Patent Number: 5,801,318

[45] Date of Patent: Sep. 1, 1998

[54] METHOD OF MANUFACTURING COPPER POWDER HAVING EXCELLENT DISPERSIBILITY AND SMALL PARTICLE DIAMETER DEVIATION

[75] Inventors: Hiroji Tani, Nagaokakyo; Naoaki Ogata, Moriyama, both of Japan

[73] Assignee: Murata Manufacturing Co., Ltd., Japan

[21] Appl. No.: 822,293

[22] Filed: Mar. 21, 1997

[30] Foreign Application Priority Data

Mar. 22, 1996 [JP] Japan ..... 8-065980

[51] Int. Cl.[6] ..... B22F 9/24

[52] U.S. Cl. ..... 75/373; 75/370

[58] Field of Search ..... 75/332, 370, 371, 75/373

[56] References Cited

U.S. PATENT DOCUMENTS 3,844,763 10/1974 Burkin ..... 75/373

4,863,510 9/1989 Tamemasa et al. ..... 75/370

FOREIGN PATENT DOCUMENTS 59-116303 7/1984 Japan ..... 75/373

62-27508 2/1987 Japan ..... 75/373

3-287707 12/1991 Japan ..... 75/373

*Primary Examiner*—George Wyszomierski

*Attorney, Agent, or Firm*—Ostrolenk, Faber, Gerb & Soffen, LLP

[57] ABSTRACT

Metal copper powder having excellent dispersibility and small particle diameter deviation is manufactured by adding a reducing agent into a solution containing a copper compound and a dispersion agent to precipitate metal copper powder. The solution may further include ammonia so that copper ammonia complex ions exist in the solution. The dispersion agent is either a phosphate such as pyrophosphate, tripolyphosphate, tetrapolyphosphate, metaphosphate and hexametaphosphate or a water-soluble polymer such as naphthalenesulfonate formaldehyde polycondensate, polyvinyl alcohol, carboxymethylcellulose salts, arabic gum, adipate and polycarboxylate.

16 Claims, No Drawings

METHOD OF MANUFACTURING COPPER POWDER HAVING EXCELLENT DISPERSIBILITY AND SMALL PARTICLE DIAMETER DEVIATION

BACKGROUND OF THE INVENTION

1. Field of the Invention

The present invention relates to a method of manufacturing copper powder, and more particularly to a method of manufacturing copper powder which has excellent dispersibility and is used, for example, in a copper conductive paste for forming electrodes of electronic components.

2. Description of the Related Art

A copper conductive paste have been widely used for forming electrodes of ceramic electronic components such as chip capacitors, chip resistors, etc. Copper powder used in such a copper conductive paste is conventionally prepared as the following processes.

Specifically, according to a method disclosed in Japanese patent Publication (Kokoku) 5-57324, a copper hydroxide slurry is first precipitated by reacting a solution containing copper ions and an alkali. The copper hydroxide slurry is then reduced to a copper oxide slurry by adding hydrazine or a hydrazine compound (reducing agent). After the slurry is decanted, water is poured into the copper oxide slurry, and hydrazine or a hydrazine compound is added to the mixture to precipitate metal copper powder.

According to another method disclosed in Japanese patent Publication (Kokoku) 59-12723, hydrazine or a hydrazine compound is added to a solution containing copper carbonate, and the solution is heated at a temperature of 40° to 150° C., thereby precipitating metal copper powder.

Copper powder used in a copper conductive paste is required to have small deviation in particle diameters and excellent dispersibility in order to precisely control the thickness of a copper electrode formed with the conductive paste. However, the copper powder prepared by the aforementioned first method has a large deviation in particle diameter. The copper powder prepared by the aforementioned second method includes much coagulated material and is poor in dispersibility.

For the foregoing reasons, there is a need for a method for preparing copper powder which has both small deviation in particle diameter and excellent dispersibility.

SUMMARY OF THE INVENTION

The present invention provide a method for manufacturing copper powder that satisfies this need. The method includes the step of adding a reducing agent into a solution containing a copper compound and a dispersion effective amount of a dispersion agent to precipitate metal copper powder.

The solution containing a copper compound and a dispersion agent may further include ammonia so that copper ammonia complex ions exist in the solution.

The reducing agent is preferably dissolved in the solution at a temperature less than about 60° C. and then kept at a temperature of about 60° C. or more.

It is preferred that the copper compound includes at least one selected from the group consisting of copper sulfate, copper carbonate, copper formate, copper chloride and cuprous oxide.

The dispersion agent is preferably a phosphate or a water-soluble polymer. The phosphate can be selected from the group consisting of pyrophosphate (diphosphate), tripolyphosphate, tetrapolyphosphate, metaphosphate, and hexametaphosphate. The water-soluble polymer can be selected from the group consisting of naphthalenesulfonate formaldehyde polycondensates, polyvinyl alcohol, carboxymethylcellulose salts, arabic gum, adipate and polycarboxylate.

The reducing agent is preferably hydrazine or a hydrazine compound.

According to the present invention, while the metal copper ions in a solution are reduced to metal copper powder, the dispersion agent adsorbs on the surface of the metal copper powder so that each particle of the copper powder has the enhanced repulsion against others, whereby the particles of the metal copper powder are prevented from growing into large particles or coagulating with each other. Thus, the uniform particle growth of metal copper is assisted, and a metal copper powder having less coagulation and excellent dispersibility is obtained.

These and other features, aspects, and advantages of the present invention will become better understood with reference to the following description and appended claims.

DETAILED DESCRIPTION OF PREFERRED EMBODIMENTS

First Embodiment

A method for manufacturing copper powder according to the first embodiment of the present invention is characterized in that metal copper powder is precipitated by adding a reducing agent to a solution containing a copper compound and phosphate as a dispersion agent. During this step, copper ions existing in the solution are reduced by the reducing agent to metal copper in a form of powder while phosphate ions derived from the phosphate act as an agent to disperse the metal copper in the solution. More specifically, it is thought that the phosphate ions adsorb on the surface of the metal copper powder and act such that each particle of the copper powder has the enhanced repulsion to others. This would prevent the particles of the metal copper from growing to large particles as well as coagulating with each other. Thus, the uniform particle growth of metal copper would be assisted, and a metal copper powder having less coagulation and excellent dispersibility is obtained.

The copper compound used in this embodiment is preferably selected from the group consisting of copper sulfate, copper carbonate, copper formate, copper chloride and cuprous oxide. The phosphate is preferably selected from the group consisting of pyrophosphate (diphosphate), tripolyphosphate, tetrapolyphosphate, metaphosphate and hexametaphosphate. The reducing agent is preferable hydrazine or a hydrazine compound.

The reducing agent is preferably added to the solution at a temperature of less than about 60° C., and more preferably around room temperature so that the reduction reaction will not proceed substantially before the reducing agent is fully dissolved in the solution. The reduction process is then preferably performed at a temperature of the range from about 60° C. to the boiling point of the solvent used in order to promote and ensure the reduction reaction of the copper ions and to prevent the copper powder from coagulating. In the case where the solvent is water, it is preferable to perform the reduction process at a temperature of about 70° to 90° C., and more preferably, at a temperature of about 80° C.

EXAMPLE 1

395 g of copper sulfate pentahydrate and 40 g of sodium pyrophosphate were dissolved into 2.5 liters of pure water to form a solution containing a copper compound and phosphate. 200 g of hydrazine hydrate were then mixed into the solution at a temperature of about 30° C. The solution was heated to a temperature of about 80° C. and stirred at that temperature for about two hours. During this step, metal copper powder was precipitated from the solution. After the reaction completed, the metal copper powder was collected and washed.

It is confirmed by a SEM (Scanning Electron Microscopy) observation that the metal copper powder thus obtained has a particle diameter in the range of about 0.5 to 0.7 μm. It is also confirmed that the metal copper powder is not coagulated and has excellent dispersibility.

EXAMPLE 2

395 g of copper sulfate pentahydrate and 40 g of sodium tripolyphosphate were dissolved into 2.5 liters of pure water to form a solution containing a copper compound and phosphate. 200 g of hydrazine hydrate were then mixed into the solution at a temperature of about 30° C. The solution was heated to a temperature of about 80° C. and stirred at that temperature for about two hours. During this step, metal copper powder was precipitated from the solution. After the reaction completed, the metal copper powder was collected and washed.

It is confirmed by a SEM observation that the metal copper powder thus obtained has a particle diameter in the range of about 0.5 to 0.8 μm. It is also confirmed that the metal copper powder obtained is not coagulated and has excellent dispersibility.

Although sodium pyrophosphate and sodium tripolyphosphate are employed in Examples 1 and 2, respectively, the inventors have confirmed that the same results can be obtained by using tetrapolyphosphate, metaphosphate, hexametaphosphate, or a combination thereof. It is also confirmed that these phosphates can be used as a form of another salt such as a potassium salt, calcium salt, or the like.

EXAMPLE 3

200 g of basic copper carbonate and 40 g of sodium pyrophosphate were dissolved into 3 liters of pure water to form a solution containing a copper compound and phosphate. 200 g of hydrazine hydrate were then mixed into the solution at a temperature of about 30° C. The solution was heated to a temperature of about 80° C. and stirred at that temperature for about two hours. During this step, metal copper powder was precipitated from the solution. After the reaction completed, the metal copper powder was collected and washed.

It is confirmed by a SEM observation that the metal copper powder thus obtained has a particle diameter in the range of about 1.2 to 1.5 μm. It is also confirmed that the metal copper powder obtained is not coagulated and has excellent dispersibility.

EXAMPLE 4

355 g of copper formate dihydrate and 40 g of sodium pyrophosphate were dissolved into 3 liters of pure water to form a solution containing a copper compound and phosphate. 200 g of hydrazine hydrate were then mixed into the solution at a temperature of about 30° C. The solution was heated to a temperature of about 80° C. and stirred at that temperature for about two hours. During this step, metal copper powder was precipitated from the solution. After the reaction completed, the metal copper powder was collected and washed.

It is confirmed by a SEM observation that the metal copper powder thus obtained has a particle diameter in the range of about 1.2 to 1.5 μm. It is also confirmed that the metal copper powder obtained is not coagulated and has excellent dispersibility.

EXAMPLE 5

200 g of cuprous oxide and 40 g of sodium tripolyphosphate were dissolved into 3 liters of pure water to form a solution containing a copper compound and phosphate. 200 g of hydrazine hydrate were then mixed into the solution at a temperature of about 30° C. The solution was heated to a temperature of about 80° C. and kept stirred at this temperature for about two hours. During the step, metal copper powder was precipitated from the solution. After the reaction completed, the metal copper powder was collected and washed.

It is confirmed by a SEM observation that the metal copper powder thus obtained has a particle diameter in the range of about 0.6 to 0.7 μm. It is also confirmed that the metal copper powder obtained is not coagulated and has excellent dispersibility.

Comparative Example 1

200 g of basic copper carbonate were added into 3 liters of pure water to form a solution containing a copper compound. 200 g of hydrazine hydrate were then mixed into the solution at a temperature of about 30° C. The solution was heated to a temperature of about 80° C. and stirred at that temperature for about two hours. This example is to be compared with Example 3 and pyrophosphate which acts as a dispersion agent is not employed.

It is confirmed by a SEM observation that the metal copper powder thus obtained has a particle diameter in the range of about 0.1 to 1.0 μm. This result shows a greater range of particle diameter of the copper powder. The SEM observation also shows that the metal copper powder obtained has much coagulation and poor dispersibility.

Comparative Example 2

200 g of cuprous oxide were added into 3 liters of pure water to form a solution containing a copper compound. 200 g of hydrazine hydrate were then mixed into the solution at a temperature of about 30° C. The solution was heated to a temperature of about 80° C. and stirred at that temperature for about two hours. This example is to be compared with Example 5 and pyrophosphate which acts as a dispersion agent is not employed.

It is confirmed by a SEM observation that the metal copper powder thus obtained has a particle diameter in the range of about 0.3 to 0.7 μm. This result shows the variation of particle diameter of the copper powder is marginal. However, the SEM observation shows the metal copper powder obtained has much coagulation and poor dispersibility.

Second Embodiment

A method for manufacturing copper powder according to the second embodiment of the present invention is characterized in that a copper ammonia complex ion solution is first prepared by adding ammonia into a solution containing a copper compound and phosphate as a dispersion agent and that metal copper powder is then precipitated by adding a reducing agent into the copper ammonia ion complex solution. Ammonia may be added to the solution of a copper compound and phosphate as a form of aqueous ammonia or an ammonia gas. In the embodiment, the copper ions exist in the solution containing dispersion agent as copper ammonia complex ions. The copper ammonia complex ions are reduced by the reducing agent in the presence of the dispersion agent, thereby obtaining metal copper powder having less coagulation and excellent dispersibility as explained in the first embodiment.

The copper compound used in this embodiment is preferably selected from the group consisting of copper sulfate, copper carbonate, copper formate, copper chloride and cuprous oxide. The phosphate is preferably selected from the group consisting of pyrophosphate (diphosphate), tripolyphosphate, tetrapolyphosphate, metaphosphate and hexametaphosphate. The reducing agent is preferably hydrazine or a hydrazine compound.

It is preferable that the dissolution of the reducing agent and the reduction process are respectively performed at the temperatures explained in the first embodiment.

EXAMPLE 6

395 g of copper sulfate pentahydrate and 40 g of sodium pyrophosphate were dissolved into 2.5 liters of pure water to form a solution containing a copper compound and phosphate. 500 g of concentrated aqueous ammonia (28%) are then added to the solution, thereby preparing a copper ammonia complex ion solution which includes phosphate as a dispersion agent. 200 g of hydrazine hydrate were mixed into the copper ammonia complex ion solution at a temperature of about 30° C. The solution was heated to a temperature of about 80° C. and stirred at that temperature for about two hours. During the step, metal copper powder was precipitated from the solution. After the reaction completed, the metal copper powder was collected and washed.

It is confirmed by a SEM observation that the metal copper powder thus obtained has a particle diameter in the range of about 0.5 to 0.7 μm. It is also confirmed that the metal copper powder obtained is not coagulated and has excellent dispersibility.

EXAMPLE 7

355 g of copper formate dihydrate and 40 g of sodium pyrophosphate were dissolved into 2.5 liters of pure water to form a solution containing a copper compound and phosphate. 500 g of concentrated aqueous ammonia (28%) are then added to the solution, thereby preparing a copper ammonia complex ion solution which includes phosphate as a dispersion agent. 200 g of hydrazine hydrate was mixed into the copper ammonia complex ion solution at the temperature of about 30° C. The solution was heated to a temperature of about 80° C. and stirred at that temperature for about two hours. During this step, metal copper powder was precipitated from the solution. After the reaction completed, the metal copper powder was collected and washed.

It is confirmed by a SEM observation that the metal copper powder thus obtained has a particle diameter in the range of about 0.6 to 0.8 μm. It is also confirmed that the metal copper powder obtained is not coagulated and has excellent dispersibility.

Although copper sulfate and copper formate are employed in Examples 6 and 7, respectively, the inventors have confirmed that the same results can be obtained by using copper carbonate, copper chloride and cuprous oxide. It is also confirmed that tripolyphosphate, tetrapolyphosphate, metaphosphate, hexametaphosphate, or the combination thereof, can be used and that these phosphates can be used as a form of other salts such as a potassium salt, calcium salt, or the like.

Third Embodiment

A method for manufacturing copper powder according to the third embodiment of the present invention is characterized in that copper pyrophosphate is employed for both the copper compound and dispersion agent. Since copper pyrophosphate can generate copper ions and pyrophosphate ions in a solution, it is not necessary to used phosphate separately.

EXAMPLE 8

265 g of copper pyrophosphate dihydrate were added into 2.5 liters of pure water to form a solution containing copper compound and phosphate. 500 g of concentrated aqueous ammonia (28%) are then added to the solution, thereby preparing a copper ammonia complex ion solution which includes phosphate as a dispersion agent. 200 g of hydrazine hydrate were mixed into the copper ammonia complex ion solution at a temperature of about 30° C. The solution was heated to a temperature of about 80° C. and stirred at that temperature for about two hours. During this step, metal copper powder was precipitated from the solution. After the reaction completed, the metal copper powder was collected and washed.

It is confirmed by a SEM observation that the metal copper powder thus obtained has a particle diameter in the range of about 0.3 to 0.5 μm. It is also confirmed that the metal copper powder obtained is not coagulated and has excellent dispersibility.

Fourth Embodiment

A method for manufacturing copper powder according to the fourth embodiment of the present invention is same as that explained in the second embodiment except that a water-soluble polymer is used as dispersion agent. The water-soluble polymer is preferably selected from the group consisting of naphthalenesulfonates formaldehyde polycondensates, polyvinyl alcohol, carboxymethylcellulose salts, arabic gum, adipate, and polycarboxylate. The copper compound and the reducing agent explained in the second embodiment is also suitably used for the present embodiment.

EXAMPLE 9

395 g of copper sulfate pentahydrate and 15 g of naphthalenesulfonate formaldehyde polycondensate were dissolved into 2.5 liters of pure water to form a solution containing a copper compound and phosphate. 500 g of concentrated aqueous ammonia (28%) are then added to the solution, thereby preparing a copper ammonia complex ion solution which includes naphthalenesulfonate formaldehyde polycondensate as a dispersion agent. 200 g of hydrazine hydrate were mixed into the copper ammonia complex ion solution at a temperature of about 30° C. The solution was heated to a temperature of about 80° C. and stirred at that temperature for about two hours. During this step, metal copper powder was precipitated from the solution. After the reaction completed, the metal copper powder was collected and washed.

It is confirmed by a SEM observation that the metal copper powder thus obtained has a particle diameter in the range of about 0.8 to 1.2 μm. It is also confirmed that the metal copper powder obtained is not coagulated and has excellent dispersibility.

Although naphthalenesulfonate formaldehyde polycondensation was employed in Example 9, the inventors has confirmed that the same results can be obtained by using polyvinyl alcohol, carboxymethylcellulose salts, arabic gum, adipate, or polycarboxylate. It is also confirmed that copper formate, copper carbonate, copper chloride, or cuprous oxide may be used.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A method for manufacturing copper powder, comprising the step of combining a reducing agent with a solution containing a copper compound, ammonia and a phosphate dispersion agent to precipitate metal copper powder.

2. The method for manufacturing copper powder according to claim 1, wherein said copper compound is at least one member selected from the group consisting of copper sulfate, copper carbonate, copper formate, copper chloride and cuprous oxide.

3. The method for manufacturing copper powder according to claim 2, wherein said phosphate is at least one member selected from the group consisting of pyrophosphate, tripolyphosphate, tetrapolyphosphate, metaphosphate and hexametaphosphate.

4. The method for manufacturing copper powder according to claim 3, wherein said reducing agent comprises hydrazine or a hydrazine compound.

5. The method for manufacturing copper powder according to claim 1, wherein said phosphate is at least one member selected from the group consisting of pyrophosphate, tripolyphosphate, tetrapolyphosphate, metaphosphate and hexametaphosphate.

6. The method for manufacturing copper powder according to claim 1, wherein said reducing agent comprises hydrazine or a hydrazine compound.

7. The method for manufacturing copper powder according to claim 1, wherein said copper compound and said dispersion agent are both copper pyrophosphate.

8. The method for manufacturing copper powder according to claim 1, comprising the step of dissolving said reducing agent in said solution at a temperature less than about 60° C. and thereafter raising the temperature to about 60° C. or more.

9. A method for manufacturing copper powder, comprising the steps of:

providing a copper ammonia complex ion solution comprising ammonia, a copper compound and a phosphate dispersion agent; and adding a reducing agent to said copper ammonia complex ion solution to precipitate metal copper powder.

10. The method for manufacturing copper powder according to claim 9, wherein said reducing agent is added in said copper ammonia complex ion solution at a temperature of less than about 60° C. and said copper ammonia complex ion solution is then raised to a temperature of about 60° C. or more.

11. The method for manufacturing copper powder according to claim 10, wherein said copper compound is at least one member selected from the group consisting of copper sulfate, copper carbonate, copper formate, copper chloride and cuprous oxide.

12. The method for manufacturing copper powder according to claim 10, wherein said phosphate compound is at least one member selected from the group consisting of pyrophosphate, tripolyphosphate, tetrapolyphosphate, metaphosphate and hexametaphosphate.

13. The method for manufacturing copper powder according to claim 10, wherein said reducing agent includes at least one of hydrazine or a hydrazine compound.

14. A method for manufacturing copper powder, comprising the steps of:

providing a copper ammonia complex ion solution comprising ammonia, a copper compound and a dispersion agent;

adding a reducing agent to said copper ammonia complex ion solution to precipitate metal copper powder;

wherein said dispersion agent is a water-soluble polymer selected from the group consisting of naphthalenesulfonate formaldehyde polycondensate, carboxymethylcellulose salt, adipate, polycarboxylate and mixtures thereof.

15. The method for manufacturing copper powder according to claim 14, wherein said copper compound is at least one member selected from the group consisting of copper sulfate, copper carbonate, copper formate, copper chloride and cuprous oxide.

16. The method for manufacturing copper powder according to claim 14, wherein said reducing agent is hydrazine or a hydrazine compound.

* * * * *